US007418890B2

(12) United States Patent
Buchanan

(10) Patent No.: US 7,418,890 B2
(45) Date of Patent: Sep. 2, 2008

(54) WRENCH WITH SPLIT RING

(75) Inventor: Nigel Alexander Buchanan, Fife (GB)

(73) Assignee: Smart Tools Ltd, Arbroath, Angus (GB)

( * ) Notice: Subject to any disclaimer, the term of this patent is extended or adjusted under 35 U.S.C. 154(b) by 14 days.

(21) Appl. No.: 10/522,693

(22) PCT Filed: Aug. 8, 2003

(86) PCT No.: PCT/GB03/03484

§ 371 (c)(1),
(2), (4) Date: Jan. 27, 2005

(87) PCT Pub. No.: WO2004/014612

PCT Pub. Date: Feb. 19, 2004

(65) Prior Publication Data

US 2005/0247168 A1 Nov. 10, 2005

(30) Foreign Application Priority Data

Aug. 8, 2002 (GB) ..... 0218339.0

(51) Int. Cl.
*B25B 13/52* (2006.01)
*B25B 17/00* (2006.01)
*B25B 13/00* (2006.01)

(52) U.S. Cl. ..... 81/64; 81/57; 81/124.4

(58) Field of Classification Search ..... 81/64, 81/57.5, 124.4, 125.1, 91, 98–100, 106
See application file for complete search history.

(56) References Cited

U.S. PATENT DOCUMENTS 208,057 A 9/1878 Beck
610,450 A * 9/1898 Johnson ..... 81/98
651,574 A * 6/1900 Meredith ..... 81/98
1,215,726 A * 2/1917 Shew ..... 81/112
1,286,926 A 12/1918 Brightly
1,526,304 A * 2/1925 Chamberlain ..... 81/111
1,675,748 A * 7/1928 Bunker ..... 81/65.2
2,331,339 A 10/1943 Morris
2,766,648 A 10/1956 Jazwieck
2,824,476 A 2/1958 Wilson
3,015,245 A 1/1962 Dracka
3,023,652 A 3/1962 Feldman
3,044,335 A * 7/1962 Keranen ..... 81/90.1
3,575,036 A * 4/1971 Hoffman et al. ..... 72/402

(Continued)

FOREIGN PATENT DOCUMENTS

DE 599682 7/1934

(Continued)

*Primary Examiner*—Joseph J. Hail, III
*Assistant Examiner*—Alvin J. Grant
(74) *Attorney, Agent, or Firm*—Ostrager Chong Flaherty & Broitman P.C.

(57) ABSTRACT

A wrench or one way drive has a flexible head (2) with a split aperture (20) for loosely engaging a separate drive such as a socket or the head of a fastener (31) including a nut, bolt, screw or the like. Cam means, preferably pins (11,11*a*), are located on a handle (3) and engage the head (2) preferably through slots (21,22) in the head. The slots diverge outwardly so that as the handle is moved relative to the head the split aperture (20) closes and the flexible head (2) increasingly clamps a drive socket as more torque is applied to the handle.

26 Claims, 7 Drawing Sheets

U.S. PATENT DOCUMENTS

| | | | | | |
|---|---|---|---|---|---|
| 3,670,604 | A | * | 6/1972 | Fromell | 81/98 |
| 4,038,987 | A | * | 8/1977 | Komiya | 606/142 |
| 4,084,456 | A | * | 4/1978 | Pasbrig | 81/177.8 |
| 4,488,461 | A | * | 12/1984 | Hurtig | 81/98 |
| 4,534,246 | A | * | 8/1985 | McNulty | 81/111 |
| 4,546,678 | A | * | 10/1985 | Stuckey | 81/90.6 |
| 4,651,597 | A | | 3/1987 | Yang | |
| 4,967,612 | A | * | 11/1990 | Sparling | 81/64 |
| 4,970,917 | A | * | 11/1990 | McCollom | 81/53.2 |
| 5,056,383 | A | * | 10/1991 | Halpin | 81/3.43 |
| 5,557,992 | A | * | 9/1996 | Macor | 81/124.5 |
| 6,237,448 | B1 | * | 5/2001 | Haxton | 81/64 |
| 6,978,701 | B1 | * | 12/2005 | Buchanan | 81/98 |
| 7,073,413 | B2 | * | 7/2006 | Duffy et al. | 81/124.5 |

FOREIGN PATENT DOCUMENTS

| | | |
|---|---|---|
| DE | 1110580 | 7/1961 |
| DE | 1603875 | 9/1971 |
| DE | 2522696 | 12/1976 |
| FR | 592653 | 8/1925 |
| GB | 393243 | 6/1933 |
| GB | 658879 | 10/1951 |
| GB | 2007567 A | 5/1979 |

* cited by examiner

WRENCH WITH SPLIT RING

FIELD OF THE INVENTION

The present invention relates to wrenches/one way drive devices also known as "spanners", and in particular to "ring" type wrenches.

BACKGROUND OF THE INVENTION

A wrench is a tool for applying torque to fastener such as a nut, bolt, screw or the like for the purpose of tightening or slackening the fastener. The wrench has a head portion which is of a complementary shape to the periphery of the fastener in a non-rotatable manner so that a force applied to rotate the head transmits torque to the fastener. The fastener usually has an external polygonal shape, typically hexagonal or square, and the head of the wrench has a complementary internal shape and size. The head of a ring wrench is configured to substantially surround the periphery of the fastener.

The following description will refer particularly to wrenches for use with hexagonal nuts. However, it will be understood that the invention is equally applicable to wrenches and corresponding fasteners having other shapes.

A conventional ring wrench has a ring-shaped head having a curved, usually substantially circular external surface with a hexagonally shaped internal surface. Each internal surface of which can be substantially flat. In use the internal surface of the wrench head substantially engages the flat surfaces of the nut to put pressure on the corners when the fastener is tightened or slackened.

However, if the nut is undersized, damaged or worn, it is very likely that the head will "slip" and rotate around the nut burring the corners instead of properly gripping or engaging the flats or corners of the nut. A further embodiment of the present invention applies to a ratchet bar tool used for applying torque via an attached square drive and appropriate socket to a fastener for the purpose of tightening or slackening the fastener. The ratchet bar is movable relative to the socket in one direction only. Motion between the ratchet bar and the socket in the opposite direction is prevented by a set of angular teeth, which co-operate with a resilient pawl so as to create a locking motion in one direction only and free movement in the opposite direction. This operation of the socket and fastener via a ratchet bar is much more convenient in restrictive situations than the use of a fixed bar operated socket as there is seldom a requirement to remove and reattach the socket operating the fastener.

Variations of the ratchet bar are exhaustive. Most mechanisms have more and more locking teeth etc. to allow a smaller angle between drive, reposition and drive, resulting in mechanisms that whilst the angle between drive and reposition has been substantially reduced so has the amount of torque that can be safely applied to the ratchet bar without failure.

SUMMARY OF THE INVENTION

It is an object of the present invention to provide an improved wrench with which to turn fasteners, preferably those which are undersized, damaged or worn.

According to the present invention there is provided a one way drive comprising a flexible head having a split aperture therein for loosely engaging drive means for driving a fastener, an elongate handle, and cam means arranged to couple the handle and the flexible head, so that when the one way drive is about to drive a fastener the handle is moved relative to the head, the cam means is effective to close the aperture and increasingly to tighten the flexible head about the drive means as more torque is applied to the handle.

Preferably, the cam means comprises a plurality of pins mounted on the handle. Two such pins may be provided each mounted on the handle and located in slots in the flexible head for opening or closing the split aperture in the flexible head. Furthermore, the cam means may comprise a surface on the handle extending in a direction transverse to the direction in which the longitudinal axis of the handle extends for engagement with the flexible head to move the head upon the application of torque to the handle.

In one embodiment of a one way drive in accordance with the present invention the drive comprises two plates mounted on opposed sides of the handle at one end thereof to define a recess therebetween with an end surface of the handle, the flexible head being mounted in the recess. The flexible head may comprise a flexible ring having a pair of circumferentially spaced surfaces extending in a radially outward direction from an inner ring surface. Conveniently, the circumferentially spaced surfaces diverge outwardly from the inner ring surface. Preferably, an outermost free end of each surface constitutes a cam surface.

A slot can be provided in the body of the flexible ring, one on each side of the circumferentially spaced surfaces for receiving cam means therein, respectively. Preferably, each slot, one relative to the other, diverge outwardly from the inner ring surface, and cam means mounted on the handle engage each slot, respectively.

Preferably, the cam means comprises a detent located in a recess extending in an axial direction of the handle. The detent may comprise a compression spring located in the recess and a ball cam located at a free end of the compression spring for location between the outermost ends of the spaced surfaces of the head.

Conveniently, the drive may comprise a recess in each cam surface for receiving cam means therein to effect gripping of the drive upon an article to be turned without applied torque.

In one alternative embodiment of the one way drive in accordance with the present invention the handle comprises a handle portion and a plate integrally formed with the handle portion as a one piece handle.

In a further such embodiment, the handle may comprise two overlying spaced plates formed with the handle portion as a one piece handle.

The torque-tightening wrench is biased by the use of thumb and finger grip. A circular drive socket is shown separately with its circular drive portion exposed.

BRIEF DESCRIPTION OF THE DRAWINGS

Embodiments of the invention will now be described by way of example with reference to the accompanying drawings in which.

DETAILED DESCRIPTION OF THE EMBODIMENTS

Figure 1:
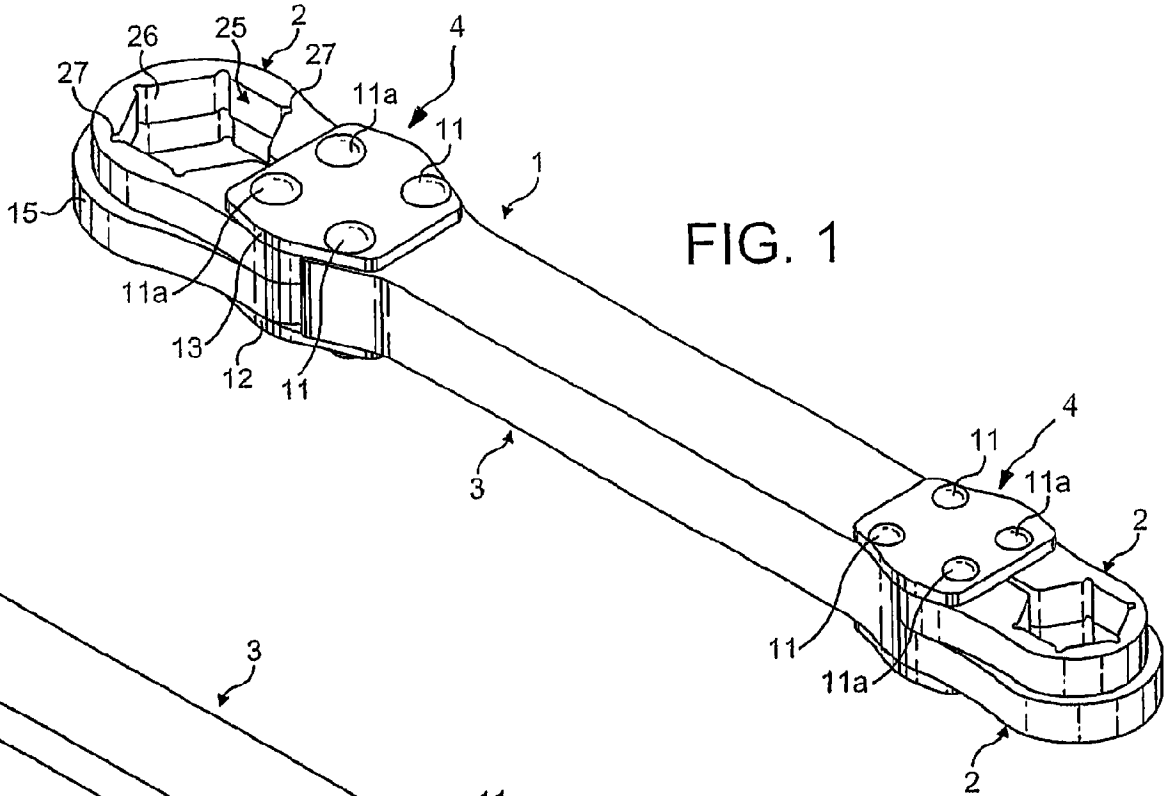
FIG. 1 is a perspective view of a torque-tightening wrench in which two head portions are located one behind the other at each end of a handle portion to provide a range of wrenches with a convenient single body package.
Figure 2:
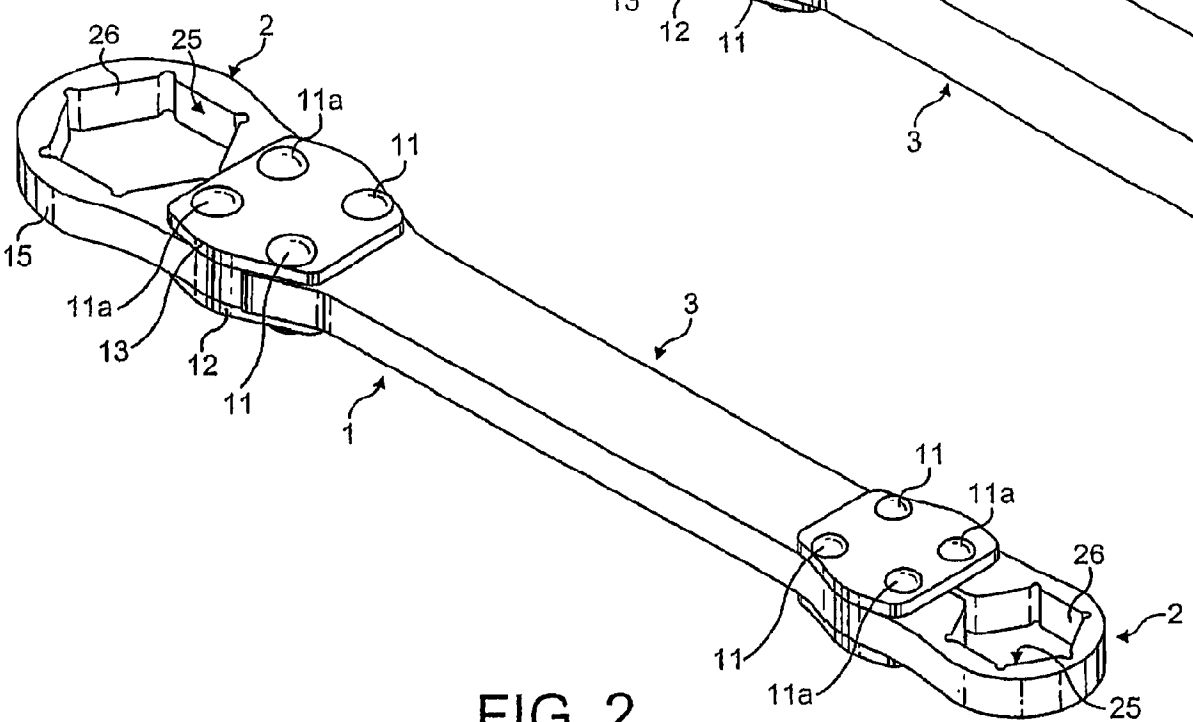
FIG. 2 is a perspective view of a torque-tightening wrench with one head portion at each end of the handle portion.

Referring more specifically to the drawings, the same reference numerals are used throughout for the same or like parts in all embodiments described below.

FIGS. 2 through 6 illustrate one embodiment of a wrench in accordance with the present invention in which a wrench (1) comprises a single flexible ring-like head portion (2), an elongate handle (3) and an intermediate interconnecting portion (4) allowing pivotable movement between the head portion (2) and handle portion (3).

Figure 6:
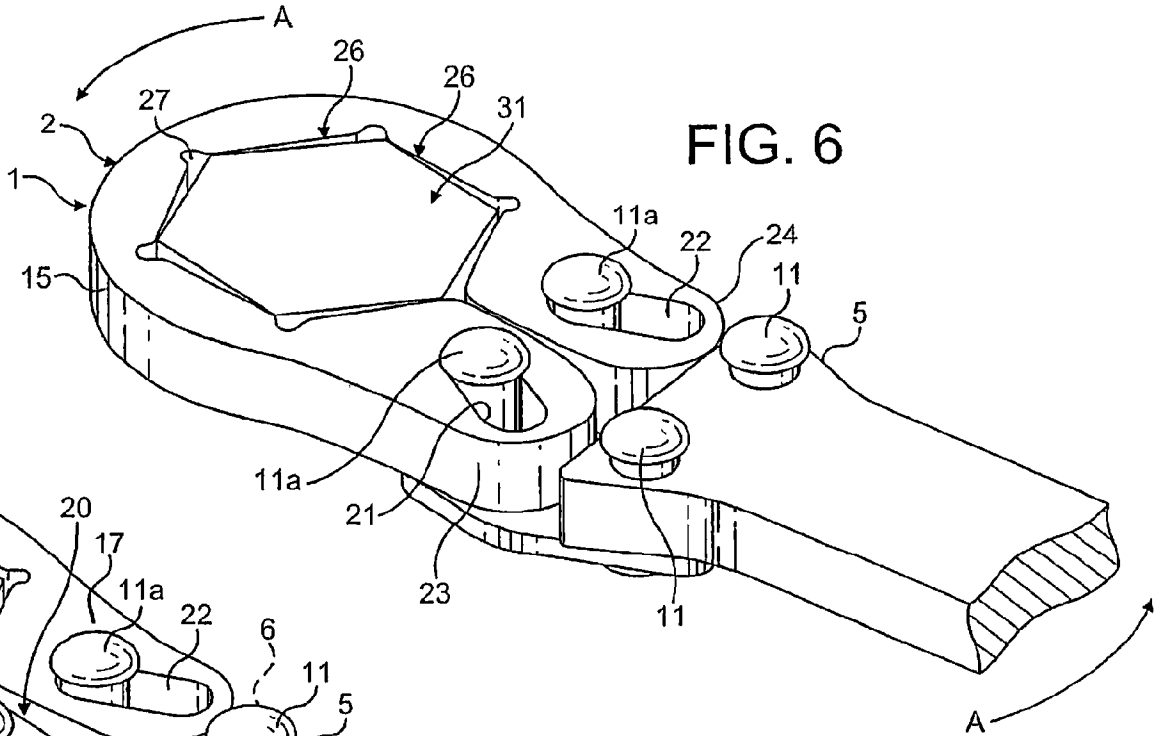
FIG. 6 is a front sectional view in perspective of the torque-tightening wrench of FIG. 5 in an operative position when the fastener is movable in an anticlockwise direction.
Figure 5:
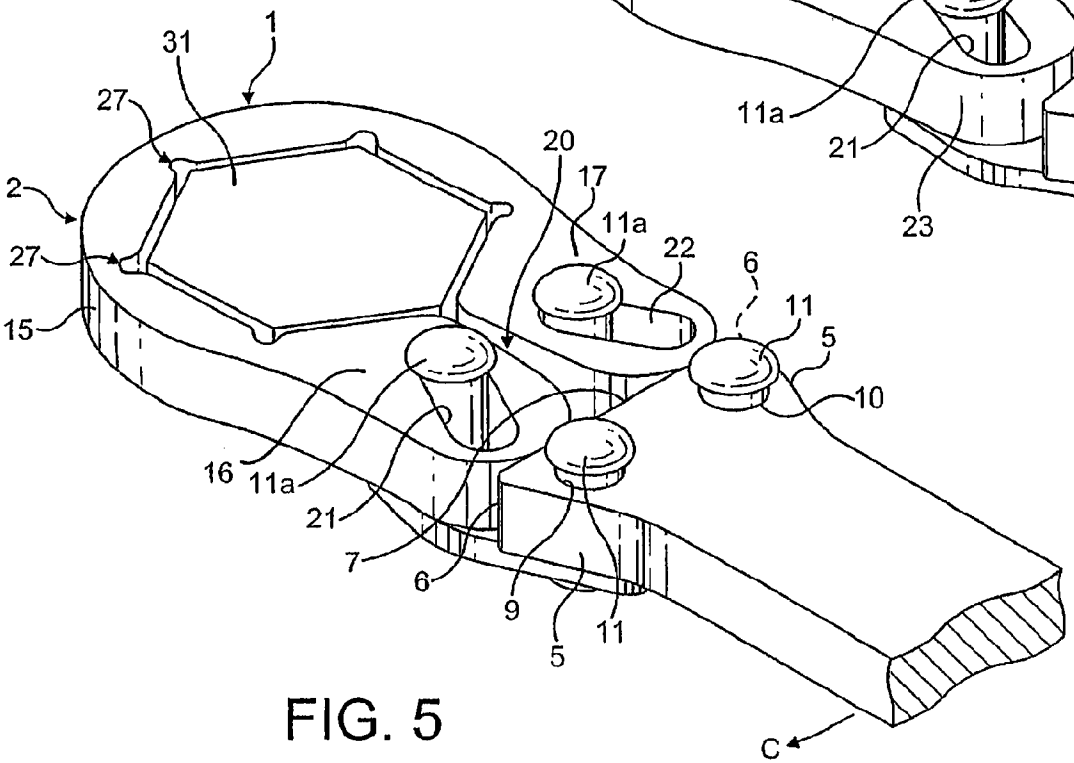
FIG. 5 is a front sectional view in perspective of the torque-tightening wrench of FIG. 2 in a rest position.

The handle portion (3) is conveniently of a consistent rectangular cross-section along its length except at each of its opposed ends where the handle has a portion (5) which tapers outwardly as shown more clearly in FIGS. 5 and 6, to terminate in rounded corners (6) extending into a laterally extending flat transverse surface (7) relative to an elongate axis of the handle (3).

Two circular apertures (9,10) are located in the outwardly tapered portion (5) of the handle (3), at each opposed end thereof. Preferably, a rivet (11) is located in each one of the apertures (9,10), respectively, for attaching plates (12,13) relative to the handle (3). The plates (12,13) extend parallel outwardly from the handle, in a direction parallel to the longitudinal axis of the handle (3). A gap (14) is provided between the plates for receiving the head portion (2) therein.

Head portion (2) is of a split ring-like configuration having a substantially circular external surface (15) extending on opposite sides into a pair of short arms (16,17) separated by a gap (20) therebetween. A slot (21,22) is located in each arm, respectively. The slots taper outwardly from near inner ring surface 25) one relative to the other towards outermost extremities of the arms (16,17) which each terminate in a curved surface (23,24), respectively, facing the transverse surface (7) of the handle (2). Rivets 11*a*) extend freely through each slot (21,22), respectively, and serve to hold the head portion (2) between plates (12 and 13) for pivotal movement of the head portion relative to the handle (3). The rivets (11) and the rivets 11*a*) are fixed one relative to the other.

Figure 3:
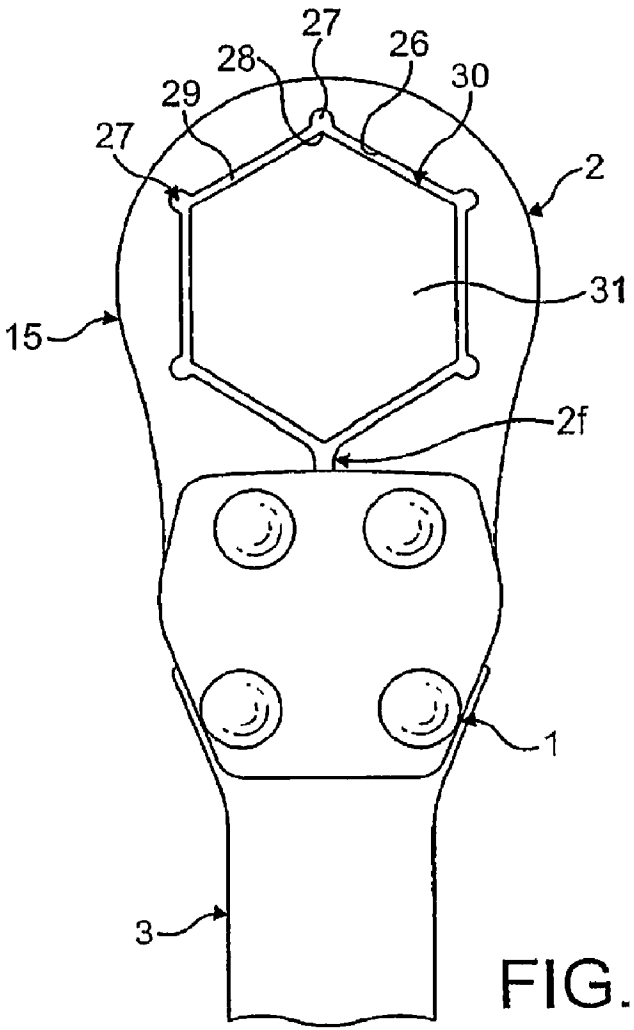
FIG. 3 is a front view of the torque-tightening wrench of FIG. 2 in a rest position.

Internal surface (25) of the head portion (2) is of a polygonal shape, being in this embodiment of a hexagonal configuration, with each side being a flat planar surface (26). A recess (27) is located at each end of each flat surface (26) (FIG. 3) for ensuring the resilience of the head portion (2) to close gap (20) when the need arises, to clamp and rotate the fastening devices. An edge (28) between two adjoining flat surface (29,30) of a fastening device such as a hexagonal headed bolt, (31), is located at the recess (27) when the wrench is in a rest position as illustrated in FIG. 3.

Figure 4:
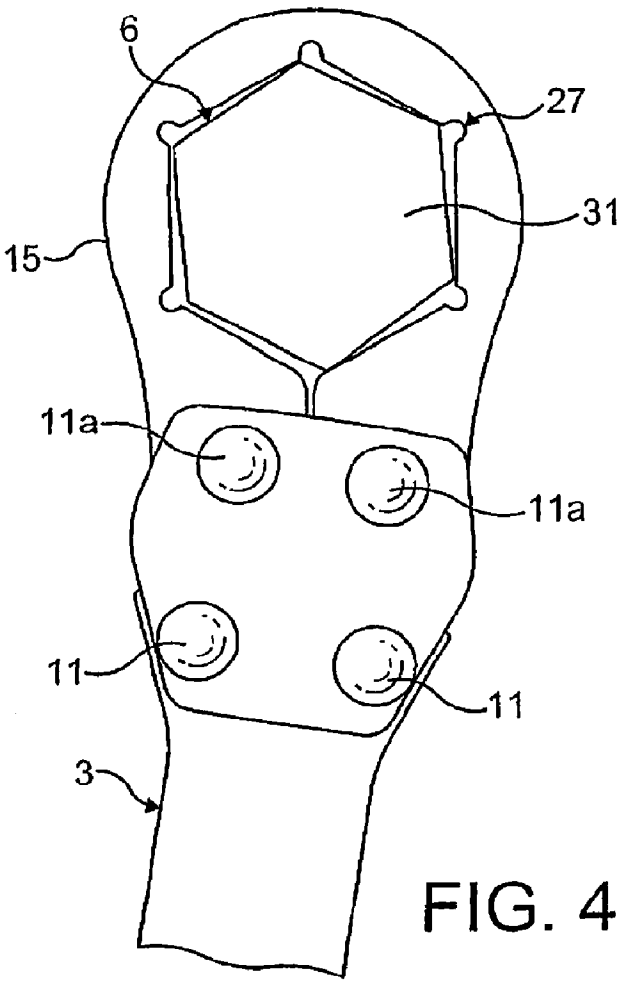
FIG. 4 is a front view of the torque-tightening wrench of FIG. 2 in an operative position in which the head portion engages a fastener by movement of the lever in a clockwise drive direction.

In one operable condition as illustrated in FIG. 4, in which torque is applied to the head of the bolt (31) the flats (26) of the internal surface of the head portion (3) engage the fastening device towards the junction (28) between flats (29,30) for example of a bolt (31).

The operation of the wrench disclosed in FIGS. 2 through 6 is more clearly illustrated in sectional views of FIGS. 5 and 6. FIG. 5 shows the wrench engaging a bolt (31) and to be in a central rest position in which curved surfaces (23,24) both engage transverse surface (7) of the tapered portion (5). Rivets (1 la) are located at the end of their respective slot (21,22) remote from the end surface (23,24) of the arms (16,17).

Assuming it is intended to untighten bolt 31) by rotating it counter clockwise, torque is applied to the handle (3) in the direction indicated by arrow A in FIG. 6 by placing a thumb against arm 17, fingers around the handle (3) and pulling with the fingers while holding the head (2) stationary. As handle (3) moves in direction A, the head portion (2) moves about the bolt (32) until the internal surface (25) of the head portion engages the external surface flats (29,30 etc) of the bolt head (32) in the manner shown in FIGS. 4 and 6.

Further torque applied in the direction of arrow A causes the transverse surface (7) to move around the curved surface (24) of arm (17) and the rivet (11*a*) in slot (21) to move along the slot (21) towards the slot end adjacent curved surface (23) of arm (16). As the rivet (11*a*) moves along slot (21) the inclination of the slot and the interaction with the rivet (11*a*) causes the arm (16) to move towards arm (17) closing gap (20) and increasing the pressure upon bolt (31) to untighten the bolt.

If the contrary action is required, that is to tighten the bolt 31), torque would be applied in the opposite direction as indicated by arrow C and the transverse surface (7) will move about curved surface (23) of arm (16). The rivet (11*a*) will subsequently move along slot (22) moving arm (17) in towards arm (16) closing gap (20) and applying increasing pressure upon bolt (31) to tighten the bolt.

In either of the above operations the closing of the gap (20) together with the resilience of ring headed portion (2) cause the flats (26) thereof to engage the flats (29,30) of the bolt head so that a greater area of the corresponding flats are in engagement and the bolt (31) is then more securely held while tightening or untightening the bolt. The plates (12, 13) with the rivets (11,11*a*) prevent any lateral separation of the head portion (2) and handle (3).

In one modified form of the invention disclosed in FIGS. 2 to 6, two ring headed portions are provided at each end of the handle (3), one behind the other, as illustrated in FIG. 1 to provide the wrench with an option of being able to fit four different sizes of fastening device using just a single wrench construction. Once one of the head sizes is selected the wrench operates in an identical manner to that just described above with reference to the embodiment of FIGS. 2 to 6.

Figure 8:
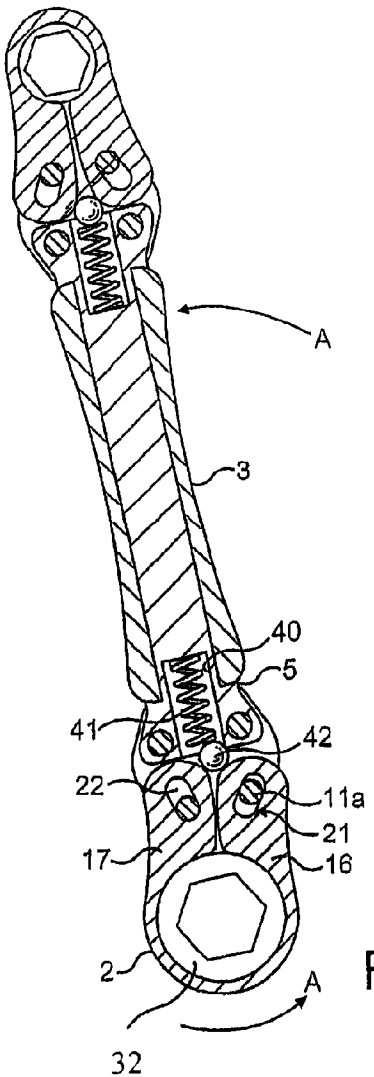
FIG. 8 is a part sectional perspective view of the torque-tightening wrench as shown in FIG. 7 with the wrench operable to turn a fastener in an anticlockwise direction.
Figure 7:
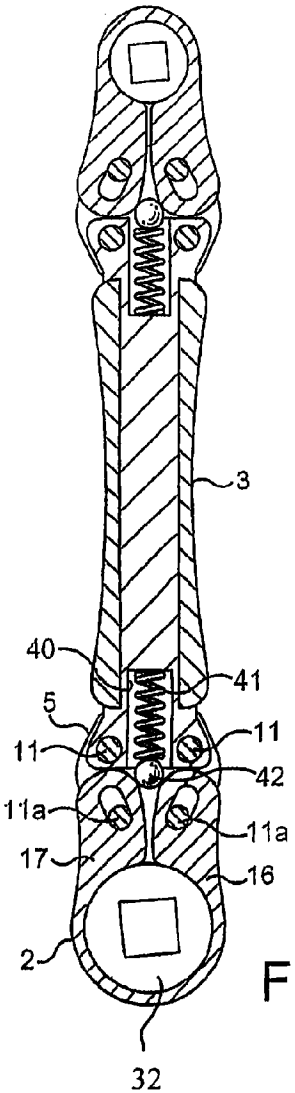
FIG. 7 is a part sectional view of an alternative embodiment of the torque-tightening wrench as shown in FIGS. 2 to 6.

FIGS. 7 and 8 illustrate an alternative embodiment of a wrench according to the present invention. The wrench shown in FIGS. 7 and 8 is constructed and operates in a substantially identical manner to the wrench disclosed in FIGS. 2 through 6. Therefore, only the modifications made to the wrench of FIGS. 7 and 8 will be described in detail hereinafter. Furthermore, because the opposed ends of the wrench are substantially identical only one end of the wrench will be referred to and that is the lower end in FIGS. 7 and 8.

As shown in FIG. 7 a cylindrical recess (40) partially extends axially along the handle (3) from the transverse surface (7) thereof at the end of the tapered portion (5). A coiled compression spring (41) is located within the recess (40) and is arranged to push a ball cam (42) between the free end of arms (16 and 17) of the flexible ring headed portion (2). FIG. 7 illustrates the wrench in the rest position in which the ball (42) is forced by the compression spring (41) between mutually facing spaced surfaces of the arms (16,17) to maintain the arms spaced apart to allow the ring shaped headed portion (2) to be easily located over a fastening device to be rotated.

When, as shown in FIG. 8, torque is applied to the handle in the anti-clockwise direction of arrow A the basic operation is as described with reference to FIGS. 5 and 6. However, in this embodiment as the handle (3) moves in the direction A, pressure on the ball is increased and the spring (41) compresses while the ball (42) moves across end surface (23) of arm (16). Continued application of torque results in the combination of slots (21,22) and rivets (11*a*) closing the gap (20) so that the ring shaped head portion exerts a sufficient increase in pressure upon the fastening device to turn the same. Again the operation will be identical to that described for the first embodiment when the handle is driven in the opposite clockwise direction to tighten the fastening device. The spring (41) and ball (42) operate in the same manner for clockwise rotation as described above as for the anti-clockwise direction.

When applied torque is removed the spring (41) and ball (42) act on surface (23) to move the handle to return towards the central position in FIG. 7 allowing repositioning of the wrench relative to the bolt (31).

The head portion (2) in this embodiment is constructed differently in that the internal surface (25) is circular rather than polygonal as in the embodiment of FIGS. 2 to 6. The drive device (32) used to fasten or release a fastener has a cylindrical external surface and at least a partial polygonal internal surface. The external surface is gripped by the cylindrical/circular internal surface of the head of the wrench and the internal surface of the drive device is polygonal and of a specific size to match the head of a corresponding polygonal shaped bolt for example.

In this regard FIG. 7 illustrates a drive device (32) having a square shaped aperture therein while FIG. 8 shows a hexagonal shaped aperture. Alternatively, these apertures may be replaced by short posts of about 2.5 cm in length and of similar hexagonal cross section so that they may be inserted in one socket for example of a set of sockets which would be placed over a device to be fastened.

Figure 9:
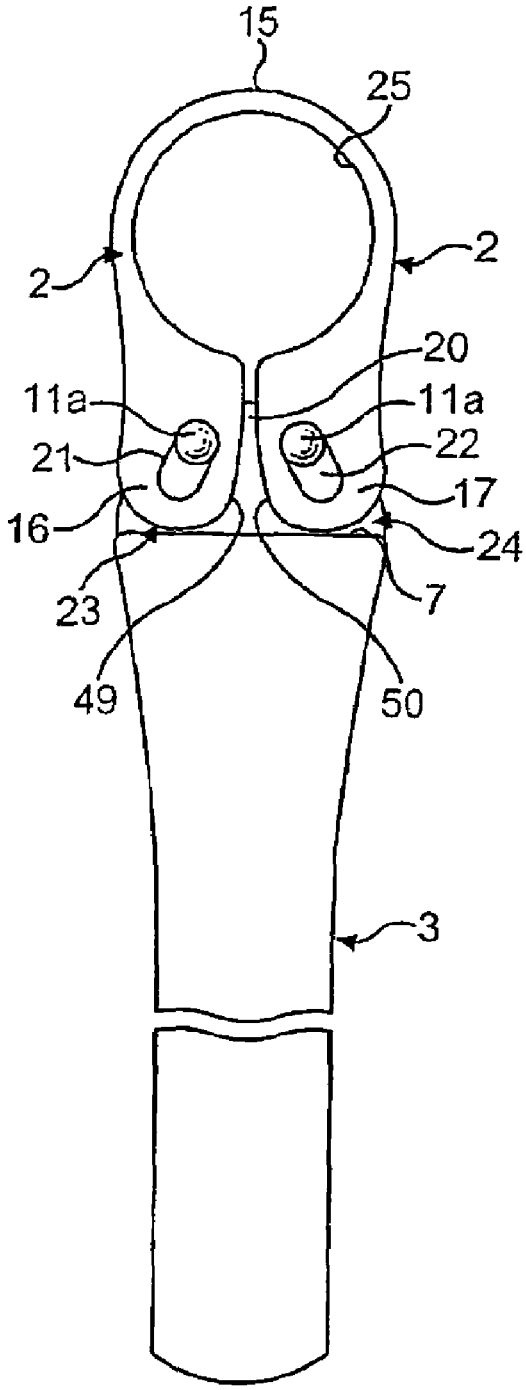
FIG. 9 illustrates another embodiment of a torque-tightening wrench wherein a circular drive socket surface is located within the flexible ring.
Figure 10:
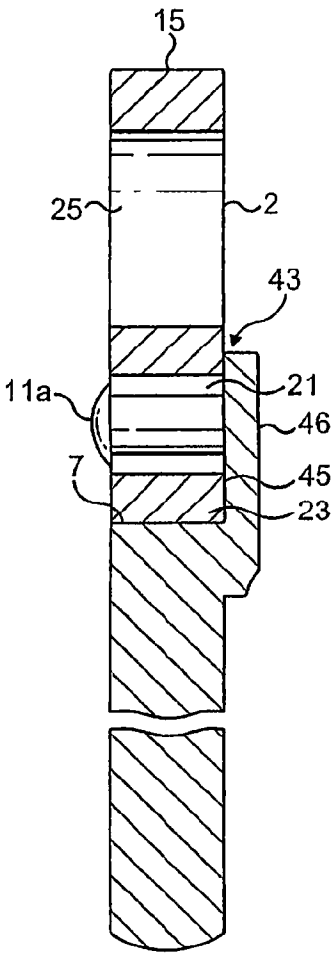
FIG. 10 is a side elevational view in section illustrating a further embodiment of the drive in accordance with the present invention.

FIGS. 9 and 10 illustrate another embodiment of a wrench in accordance with the present invention. In this embodiment the handle is of a single unitary construction having a recessed portion (45) at one end (46) thereof. The recess is defined in part by an end wall (7) of the previously described embodiments and a flat planar surface (48) extending in an elongate axial direction of the wrench.

Head portion (2) of the wrench lies in the recess (45) against both end wall (7) and on rivets (11*a*) extending outwardly through slots (21,22) in the head portion as described in regard to the previously disclosed embodiments.

In the embodiment of FIGS. 9 and 10 the head portion (2) has an inner cylindrical surface (25) and a smooth curved external surface (15). The wall thickness of the head portion (2) is thinnest at its uppermost closed end in FIG. 9 and gradually increases in thickness until a maximum at the opening (20) between open ends (16,17) of the head portion (2). End surfaces (49,50) of the open ends diverge outwardly from the inner surface (25) of the head portion to the outer surface (15) thereof. The junction between the open end and outer surface is curved and lie adjacent end surface (7).

The operation of the embodiment of FIGS. 9 and 10 is the same as that for the previous embodiments excluding the spring and ball detent and therefore will not be further described.

Figure 11:
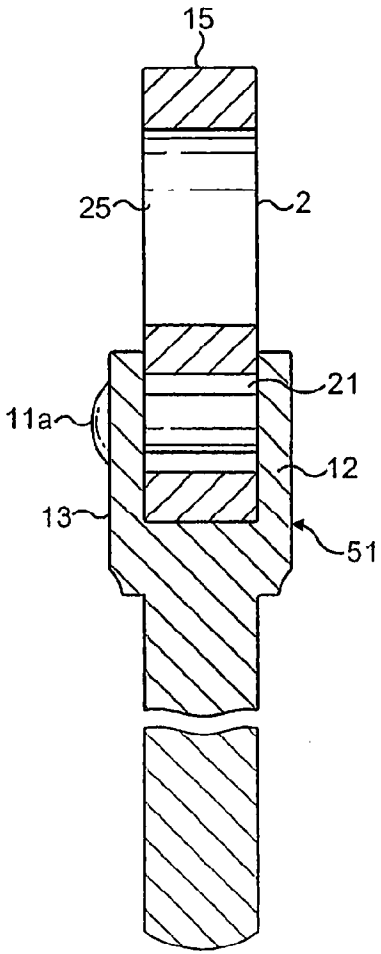
FIG. 11 is a side elevational view in section of yet another embodiment of the drive in accordance with the present invention.

The FIG. 11 embodiment is similar to that of FIGS. 9 and 10, and differs only in that the handle portion (3) has, at least at one end, a unitary construction defining a yoke (51) equivalent to two opposed attached plates. The head portion (2), equivalent to that of the embodiment of FIGS. 9 and 10, is located in a recess (52) within the yoke with pins or rivets (11*a*) secured to the yoke and projection through respective one of two slots (21,22) in arms (16,17) as previously described. The operation of the embodiment of FIG. 11 is again the same described for the previously disclosed embodiments excluding the spring and ball detent and will therefore not be further described.

Figure 13:
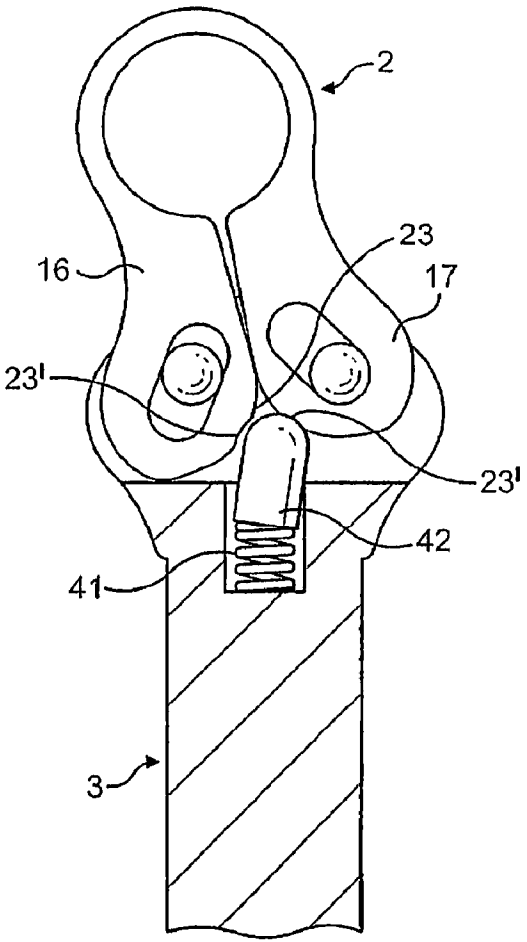
FIG. 13 is a front elevational partial sectional view of the embodiment of FIG. 12 in one drive position.
Figure 12:
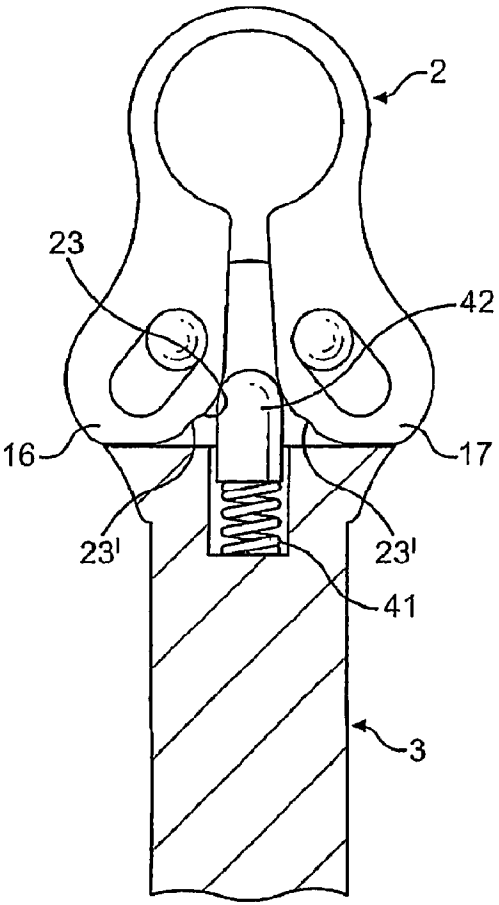
FIG. 12 is a front elevational partial sectional view of another embodiment of the invention in accordance with the present invention.

In one alternative embodiment shown in FIGS. 12 and 13 a shallow recess 23' is located in surface 23 of each arm (16,17), which acts to hold cam (42) under the force of compression spring 41. When torque is applied, as described with reference to FIG. 8, cam 42 moves out from the central position between arms (16,17), FIG. 12, across surface (23). Just as the arms (16.17) close together or are at their minimum spacing therebetween, the cam (42) enters recess 23' to hold the wrench in the fully operative or drive position, FIG. 13.

When moving the wrench in the opposite direction to reposition the wrench for example, the cam (42) has to be forced out of the recess 23'. This ensures the wrench maintains a tight grip on the bolt being turned, prior to repositioning, even though drive torque has been removed, or the operator's hand is removed or repositioned, without disengaging the wrench from the head of the bolt being turned. Once the cam (42) is out of the recess 23' the spring force of the spring (41) acts to assist in returning the wrench to its central position as shown in FIG. 12.

The cam (42) in the embodiment of FIGS. 12 and 13 is a cylinder having a curved surface at one outer end and a flat transverse surface at its opposite end for engagement by compression spring (41). A ball as in the previously described embodiments could be used.

While the embodiments of FIGS. 1 to 6 are shown to have a polygonal internal surface, preferably hexagonal, such internal surfaces may be smooth cylindrical/circular surfaces such as described with reference to the embodiments of FIGS. 7 to 13. Wherever such a cylindrical/circular construction is used it is ideal for clamping onto bolts having burred edges or cylindrical sockets provided with internal polygonal surfaces to engage a bolt head having similarly polygonal external surfaces.

In all such cases the drive tool when clamped onto the external cylindrical surface or substantially cylindrical surface, increases the clamping effect as more and more torque is applied. When movement is required in an opposite direction to say reposition the drive tool, the removal of the applied torque causes the clamping effect to be reduced sufficiently for slippage to occur between the drive tool and socket fastening device. Once repositioning has occurred torque can again be applied immediately using the thumb and fingers.

I claim:

1. A bi-directional tool for applying a drive torque comprising:

a flexible head having a split aperture therein that defines a torque-applying gripping surface;

an elongate handle; and cam means arranged to couple the handle and the flexible head and effective to close the split aperture and increasingly tighten a grip applied by the torque-applying gripping surface as more torque is applied to the handle, said cam means comprising two slots provided in the flexible head and respective pins located in said slots, said slots extending divergently outwardly with respect to said split aperture and said pins being fixedly connected to said elongate handle wherein the flexible head comprises a flexible ring having a pair of circumferentially spaced surfaces extending in a radially outward direction from said torque-applying gripping surface to define said split aperture.

2. A drive tool as claimed in claim 1, wherein the cam means further comprises a surface on the elongate handle extending in a direction transverse to a longitudinal axis of the elongate handle for engagement with the flexible head to move the flexible head when said torque is applied to the handle.

3. A drive tool as claimed in claim 1, further comprising two plates mounted on opposed sides of the elongate handle at one end thereof to define an end surface of the handle with a recess therebetween, a portion of the flexible head being mounted in the recess.

4. A drive tool as claimed in claim 1, wherein the circumferentially spaced surfaces diverge outwardly from the torque-applying gripping surface.

5. A drive tool as claimed in claim 1, wherein said torque-applying gripping surface comprises a plurality of surface portions that define a polygonal aperture.

6. A drive tool as claimed in claim 5, wherein said torque-applying gripping surface defines respective recesses that separate adjacent said surface portions.

7. A drive tool as claimed in claim 6, wherein said recesses are arcuate in cross-section.

8. A drive tool as claimed in claim 1, wherein said flexible head is irremovably coupled to said elongate handle portion by said cam means.

9. A drive tool as claimed in claim 1, wherein each of said diverging slots is a closed slot having opposed ends.

10. A drive tool as claimed in claim 1, further comprising a detent comprising a compression spring located in a recess extending axially in said elongate handle and a ball cam located at a free end of the compression spring for location between radially outermost ends of the circumferentially spaced surfaces of the flexible head.

11. A drive tool as claimed in claim 1, comprising respective recesses in said circumferentially spaced surfaces for receiving a detent member therein to lock said split aperture in a closed condition absent a torque applied to said elongate handle.

12. A drive tool as claimed in claim 11, wherein the detent member comprises a cylinder having a curved surface at one end for engaging in the respective recesses.

13. A drive tool as claimed in claim 1, wherein the elongate handle comprises a handle portion and a plate formed integrally with the handle portion as a one piece handle and said pins are fixed to said plate.

14. A drive tool as claimed in claim 1, wherein the elongate handle comprises an elongate portion and two opposed spaced plates formed with the elongate portion as a one piece handle and extending from an end of the elongate portion to define a recess for housing a portion of said flexible head to which the handle is coupled by said cam means.

15. A bi-directional drive tool for applying a drive torque, said drive tool comprising:

a flexible head having an internal torque-applying gripping wall defining an opening and a slot extending from said opening to an outer wall of said flexible head; and an elongate handle pivotally connected to said flexible head by a cam mechanism, said cam mechanism comprising two apertures defined by said flexible head and respective pivot members that are fixed with respect to the elongate handle, said pivot members extending through the respective apertures and said apertures defining respective elongate camming surfaces that diverge away from said opening such that when an input torque is applied to said elongate handle a force that tends to close said slot is applied to the flexible head via said cam mechanism to cause the application of a gripping force by said torque-applying gripping wall;

wherein said slot extends between said elongate apertures.

16. A drive tool as claimed in claim 15, wherein said flexible head comprises a generally C-shaped arcuate portion and respective ears extending from opposite ends of said arcuate portion, said slot being defined between said ears and said elongate apertures being disposed one in each ear.

17. A drive tool as claimed in claim 15, wherein said flexible head comprises a first portion that defines said torque-applying gripping surface and opposed ears extending from said first portion and defining said slot therebetween, said elongate handle comprising respective surface portions operable to bear against the ears according to the direction of said input torque applied to the elongate handle to increase said force that tends to close said slot.

18. A drive tool as claimed in claim 15, further comprising a resiliently biased detent member carried by said elongate handle, the arrangement being such that said resiliently biased detent member engages in an end of said slot at said outer wall of the flexible head when the elongate handle is aligned with the slot.

19. A drive tool as claimed in claim 18, wherein respective recesses are defined in said outer wall on either side of said end of the slot for locking engagement with said resiliently biased detent member when said lever arm is pivoted out of alignment with said slot.

20. A drive tool as claimed in claim 15, further comprising a second said flexible head pivotally connected to said elongate handle by said cam mechanism, said flexible heads being disposed one above the other in overlying relationship.

21. A bi-directional drive tool for applying a drive torque, said drive tool comprising:

a flexible head having an internal torque-applying gripping wall defining an opening and a slot extending from said opening to an outer wall of said flexible head; and an elongate handle pivotally connected to said flexible head by a cam mechanism, said cam mechanism comprising two apertures defined by said flexible head and respective pivot members that are fixed with respect to the elongate handle, said pivot members extending through the respective apertures and said apertures defining respective elongate camming surfaces that diverge away from said opening such that when an input torque is applied to said elongate handle a force that tends to close said slot is applied to the flexible head via said cam mechanism to cause the application of a gripping force by said torque-applying gripping wall;

wherein said internal torque-applying gripping wall comprises a plurality of segments arranged such that said opening is polygonal and respective recesses between adjacent said segments.

22. A drive tool as claimed in claim 21, wherein said recesses have a curved cross-section.

23. A bi-directional drive tool for applying a drive torque, said drive tool comprising:

a flexible head having an internal torque-applying gripping wall defining an opening and a slot extending from said opening to an outer wall of said flexible head; and an elongate handle pivotally connected to said flexible head by a cam mechanism, said cam mechanism comprising two apertures defined by said flexible head and respective pivot members that are fixed with respect to the elongate handle, said pivot members extending through the respective apertures and said apertures defining respective elongate camming surfaces that diverge away from said opening such that when an input torque is applied to said elongate handle a force that tends to close said slot is applied to the flexible head via said cam mechanism to cause the application of a gripping force by said torque-applying gripping wall;

wherein said internal torque-applying gripping wall is a curved wall.

24. A drive tool as claimed in claim 23, further comprising a drive device having a curved external wall for mating with said internal torque-applying gripping wall and defining a polygonal aperture for engaging a fastener to which a drive torque is to be applied.

25. A drive tool as claimed in claim 23, further comprising a drive device having a curved external wall for mating with said internal torque-applying gripping wall and including a post insertable into a socket that is engageable with a fastener to which a drive torque is to be applied.

26. A bi-directional drive tool for use in applying a torque to a fastener, said tool comprising:

a flexible head having a first portion that includes an internal torque-applying gripping wall that defines an opening and first and second projecting portions extending radially outwardly with respect to said opening from said first portion, said projecting portions defining a slot therebetween that extends from a first open end that opens into said opening to a second open end at an outer wall of the flexible head; an elongate handle pivotally connected to said flexible head, said elongate handle having a longitudinal axis and being pivotable to a first side and a second side of a neutral position in which neutral position said longitudinal axis is aligned with said slot; and a cam mechanism comprising a first aperture defined in said first projecting portion and disposed on said first side of the neutral position, a second aperture defined in said second projecting portion and on said second side of the neutral position and respective pivot pins extending through said first and second apertures and fixedly connected to said elongate handle, the first and second apertures defining respective elongate camming surfaces that diverge away from said opening whereby when an input torque applied to said elongate handle causes the handle to pivot to said first side of the neutral axis the pivot pin in said first aperture engages an end of said aperture to act as a fulcrum and the pivot pin in said second aperture moves along the camming surface of the aperture away from said opening applying a force to the second projecting portion that causes the slot to narrow to close the opening to cause said internal torque-applying gripping wall to grip for applying said input torque to a fastener and when an input torque applied to said elongate handle causes the handle to pivot to said second side of the neutral axis the pivot pin in said second aperture engages an end of said aperture to act as a fulcrum and the pivot pin in said first aperture moves along the camming surface of the aperture away from said opening applying a force to the first projecting portion that causes the slot to narrow to close the opening to cause said internal torque-applying gripping wall to grip for applying said torque to a fastener.

* * * * *